United States Patent [19]

Meister

[11] Patent Number: 4,522,508

[45] Date of Patent: Jun. 11, 1985

[54] WATCH CASE

[75] Inventor: Leonhard Meister, Selzach, Switzerland

[73] Assignee: Montres Universal S.A., Geneva, Switzerland

[21] Appl. No.: 640,606

[22] Filed: Aug. 14, 1984

[30] Foreign Application Priority Data

Aug. 22, 1983 [CH] Switzerland ..... 4566/83

[51] Int. Cl.[3] ..... G04B 37/00

[52] U.S. Cl. ..... 368/276; 368/294

[58] Field of Search ..... 368/88, 276, 291–292, 368/294, 296, 309–310, 314

[56] References Cited

U.S. PATENT DOCUMENTS 1,802,080 4/1931 Jandoc .
4,397,566 8/1983 Lederrey ..... 368/276
4,417,821 11/1983 Herchenbach ..... 368/276
4,421,423 12/1983 Lederrey ..... 368/276

FOREIGN PATENT DOCUMENTS 3039756 5/1982 Fed. Rep. of Germany .

*Primary Examiner*—Vit W. Miska
*Attorney, Agent, or Firm*—Parkhurst & Oliff

[57] ABSTRACT

The bezel of the watchcase is made up of an annular zone supporting the glass and of four pillars extending radially outward at 45° angles relative to the 3 o'clock-9 o'clock and 6 o'clock-12 o'clock axes. At the same positions the caseband has four indentations into which the pillars are fitted so as to come in contact with the inside face of the back. Screws fix the back to the bezel, thereby compressing two gaskets and securing the caseband between those two parts. At the location of 3 o'clock, the caseband is pierced by a radial passage provided for a control stem.

8 Claims, 7 Drawing Figures

WATCH CASE

This invention relates to watch cases, and more particularly to a watch case of the type having an annular main part constituting a caseband and two auxiliary parts constituting a bezel and a back.

Watch cases of this type have been known for a long time as "three-piece cases." U.S. Pat. No. 1,802,080, for example, describes such a design in which the parts are assembled by means of four screws distributed along the circumference of the case and passing through the back and the caseband in such a way as to enter tapped blind holes in the bezel. Another design of the same type is proposed for a thin watchcase in West German Disclosed Application (DOS) No. 30 39756.

As a matter of fact, the prior art designs have several drawbacks, especially when they must be adapted to very thin watch movements. First of all, they require the machining of undercuts or grooves for the gaskets and stop shoulders on each side of the caseband so that when the screws are tightened, each of the gaskets will be compressed but not crushed and the fastening will be rigid. However, even with these precautions, which considerably increase the cost price of the watchcase, the fluid-tightness of the watch is not assured because as a result of machining deviations between the parts, as are inevitable in mass production, the two gaskets will not be compressed in the same way in all the parts produced. Moreover, in the prior art designs, each of the three parts must be quite thick at certain locations, so that it is difficult to reduce the overall thickness of the watch as much as would be desirable without weakening its rigidity.

It is an object of this invention to provide an improved watchcase which remedies these drawbacks and makes it possible to use a part of substantial size, hence a rigid part, as the caseband, even in a watchcase of reduced thickness.

To this end, in the watchcase according to the present invention, of the type initially mentioned, the improvement comprises indentations distributed around the circumference of the caseband, one of the auxiliary parts being formed with integral pillars fitted in the indentations, against which pillars the other auxiliary part is fixed.

Two preferred embodiments of the invention will now be described in detail with reference to the accompanying drawings, in which.

Figure 1:
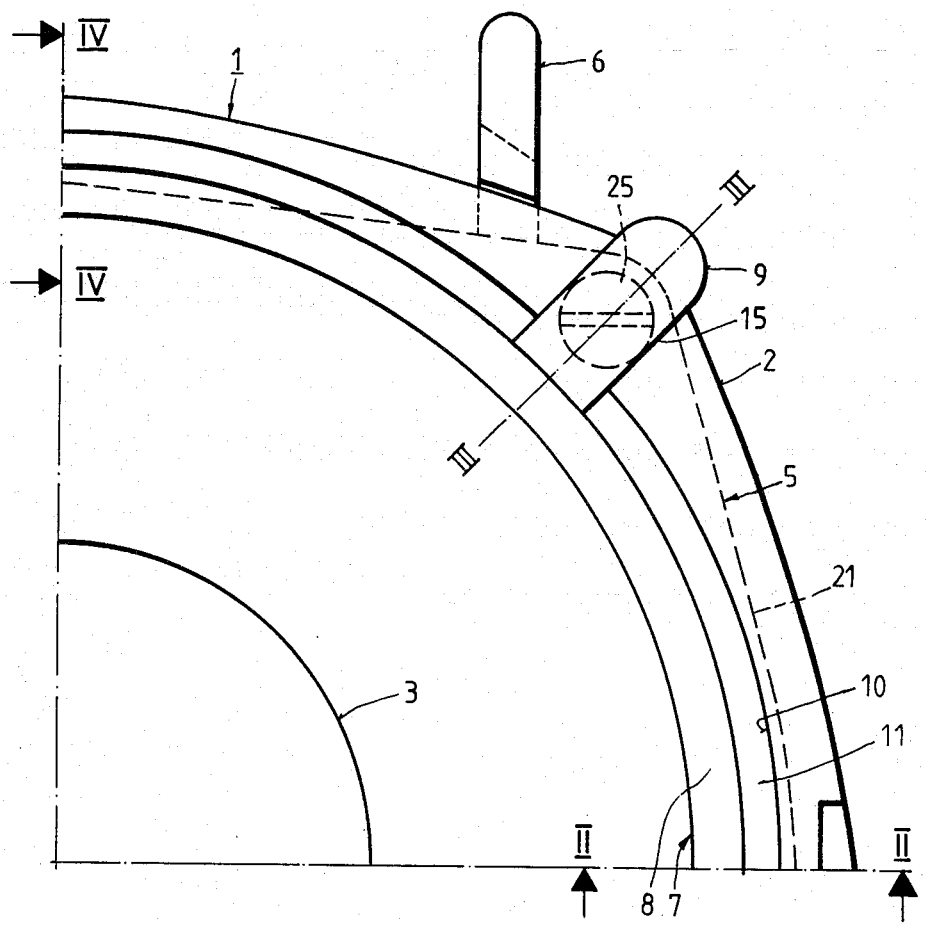
FIG. 1 is a partial top plan view of the first embodiment.

The main part and the two auxiliary parts making up the watchcase in the first embodiment are clearly visible in FIG. 1. The main part 1 constituting the caseband is an annular part, the outside periphery of which defines the outer circumference of the case. This peripheral line is designated by reference numeral 2 in FIG. 1. In the particular instance of FIG. 1 it has the shape of an octagon with rounded angles. However, it will be understood that the shape of the outer periphery of the caseband might instead be round or rectangular or some other shape. On the inside, caseband 1 is bounded by a circular inner rim 3, the radius of which corresponds to that of a watch movement 4 (FIGS. 3 and 4) intended to be accommodated in the case. If need be, a casing-ring may also be provided between caseband 1 and movement 4.

FIG. 1 further shows the periphery of one of the auxiliary parts forming the back 5. This auxiliary part is a plate provided at four locations on its circumference with protruding elements 6 acting as horns and consequently intended to hold, pairwise, the ends of bars for attaching the watchband. The shape of protruding elements 6 will be discussed below.

Figure 2:
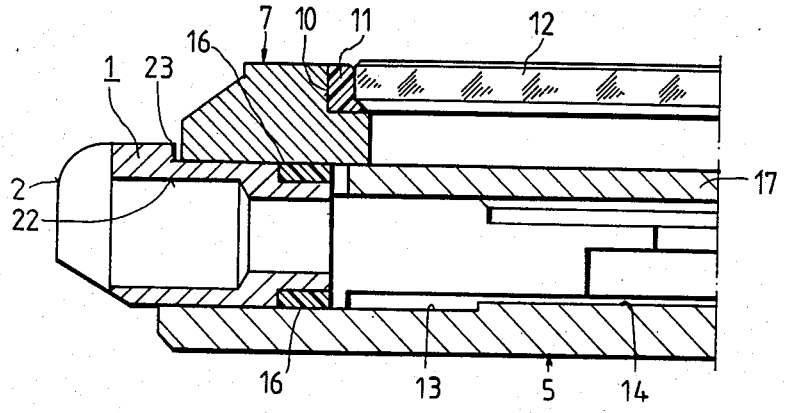
FIG. 2 is a partial section taken on the line II—II of FIG. 1.
Figure 3:
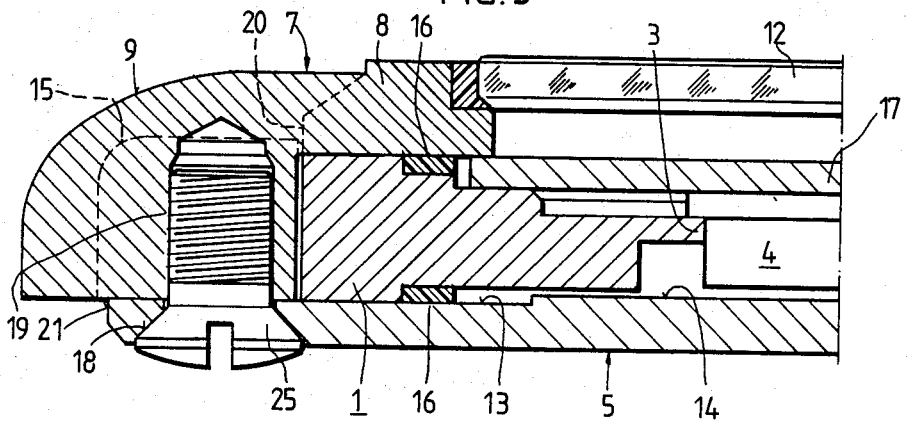
FIG. 3 is a partial section taken on the line III—III of FIG. 1.
Figure 4:
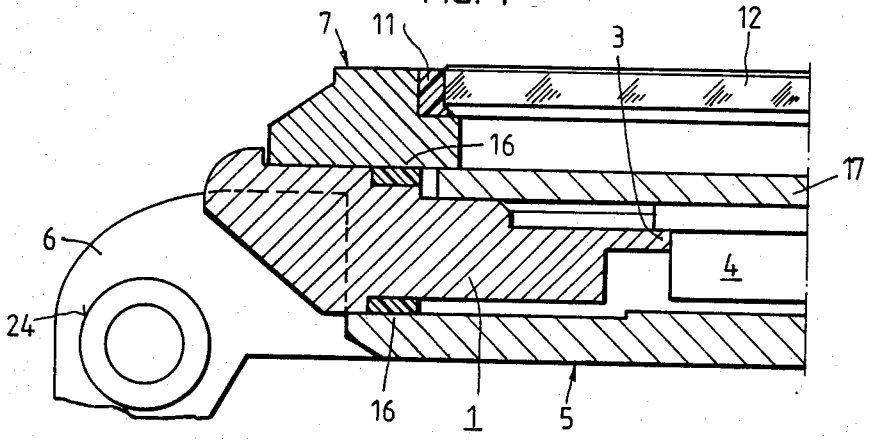
FIG. 4 is a partial section taken on the line IV—IV of FIG. 1.

Mounted on the upper surface of caseband 1 is a bezel 7 which comprises a narrow annular portion 8 and four protruding elements 9 acting as pillars and extending radially outward at 45-degree angles to the 3-9 o'clock and 6-12 o'clock axes. As will be seen from FIGS. 2, 3, and 4, bezel 7 has in the inner rim of its annular portion 8 a groove 10 in which is fitted a gasket 11 by means of which a glass 12 is fixed fluid-tightly. Glass 12 will preferably be a thin, flat piece of sapphire, for the use of sapphire is known to make possible a reduction in the thickness of the glass and is therefore particularly advantageous in producing thin watchcases. The shape of pillars 9 in axial section is shown in FIG. 3, where they are seen to extend radially outward relative to annular zone 8 of bezel 7, as well as downward to the level of the flat inside face 13 of back 5. Face 13 extends to the periphery of back 5 and is bounded on the inside by a slight projection 14 which reinforces the central part of back 5.

At the locations of the parts forming pillars 9 of bezel 7, caseband 1 has four radial indentations 15 bounded by parallel plane faces, the width of these indentations being equal to that of pillars 9, so that when bezel 7 is placed upon caseband 1, the lower portions of pillars 9 can fit into indentations 15.

A gasket 16 is fitted in each of two annular recesses on the upper and lower faces of caseband 1, respectively. The two gaskets 16 are circular, but gaskets of any other shape can be used if the inside contour of bezel 7 is other than round, and if a dial 17 fixed on movement 4 is likewise other than round. In their relaxed state, gaskets 16 are slightly thicker than their respective annular recesses are deep, so that when pillars 9 are fitted into indentations 15, and back 5 is put in place facing the lower surface of caseband 1, gaskets 16 are squeezed between the underside of bezel 7 and the top of back 5. By means of screws 25 entering conical holes 18 in the corners of back 5 and tapped blind holes 19 in the underside of pillars 9, the watchcase can be fluid-tightly closed. When screws 25 are tightened in holes 19, back 5 is fixed to bezel 7 under conditions such that the periphery of face 13 is pressed against the flat undersides of pillars 9, gaskets 16 being squeezed axially, and caseband 1 being held in place between the two auxiliary parts of the case.

Except at the locations of indentations 15, the sidewall of caseband 1, i.e., outside periphery 2, extends beyond outer sidewall 20 of bezel 7 and outer sidewall 21 of back 5. At the location of 3 o'clock, caseband 1 is pierced by a radial passage 22, into the outer part of which a tube (not shown) will be driven, protecting a radial control stem bearing a crown of conventional shape. The diameter of radial passage 22 increases to a point where the upper and lower generatrices of that passage are respectively situated at the levels of each of the gaskets 16 (FIG. 2).

Whereas bezel 7 is centered relative to back 5 by the fitting of the conical heads of screws 25 in conical holes 18 and the shanks of those screws in blind holes 19, caseband 1 is centered relative to the two auxiliary parts by means of the flank of a ledge 23 cut into the top surface of caseband 1, the bottom of ledge 23 forming the upper surface which is in contact with bezel 7. The flank of ledge 23 encircles the entire periphery and part of the height of annular zone 8 of bezel 7.

Finally, the watchcase described above includes means for attachment to a watchband. These means consist of the two pairs of elements 6 protruding from back 5. As may be seen in FIG. 4, protruding elements 6 extend upward and downward so as to be high enough for the ends of a bar 24 to engage between the two elements of each The upper projecting part of each element 6 faces sidewall 2 of caseband 1.

Figure 5:
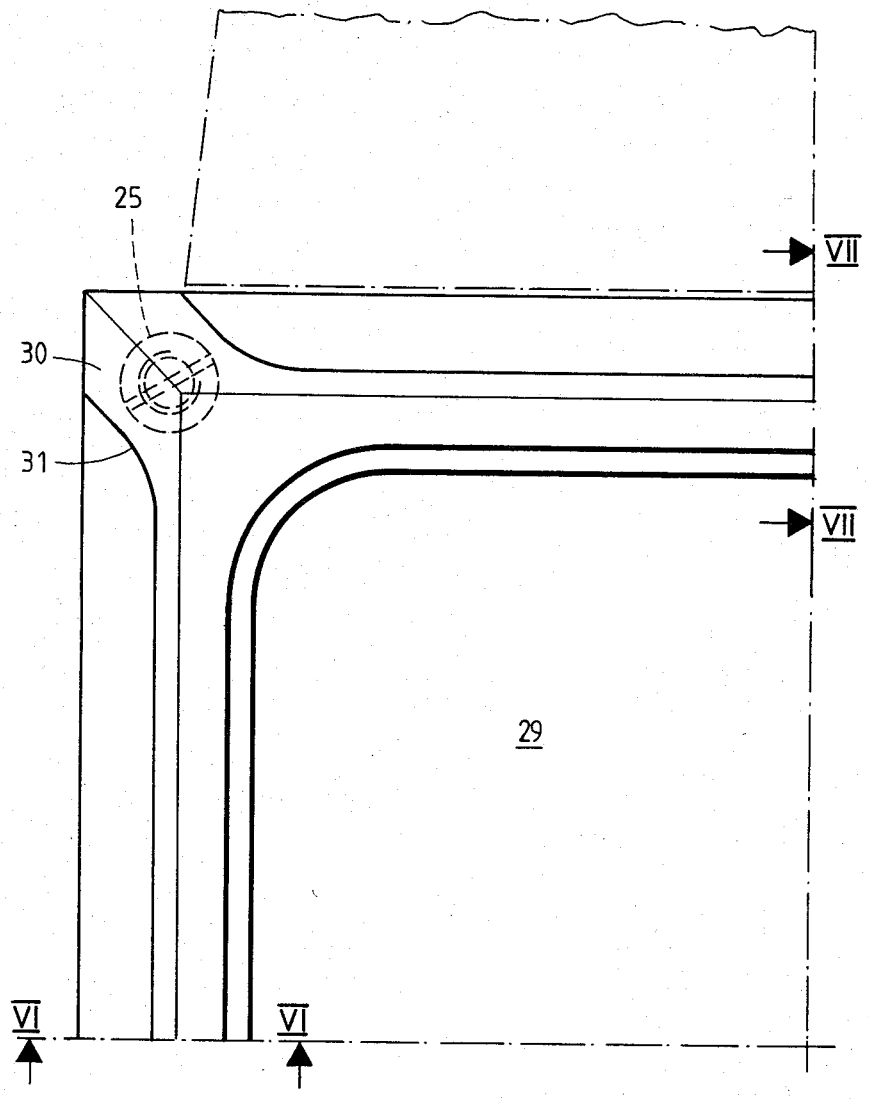
FIG. 5 is a top plan view of the second embodiment.
Figure 6:
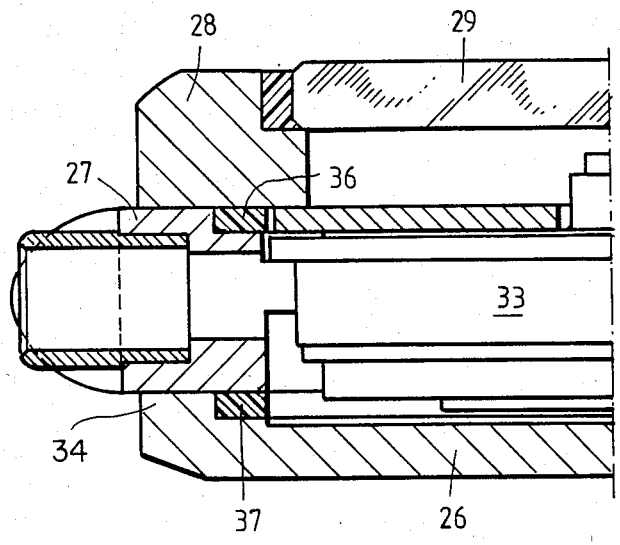
FIG. 6 is a partial section taken on the 3 o'clock-9 o'clock axis of the watchcase of FIG. 5.
Figure 7:
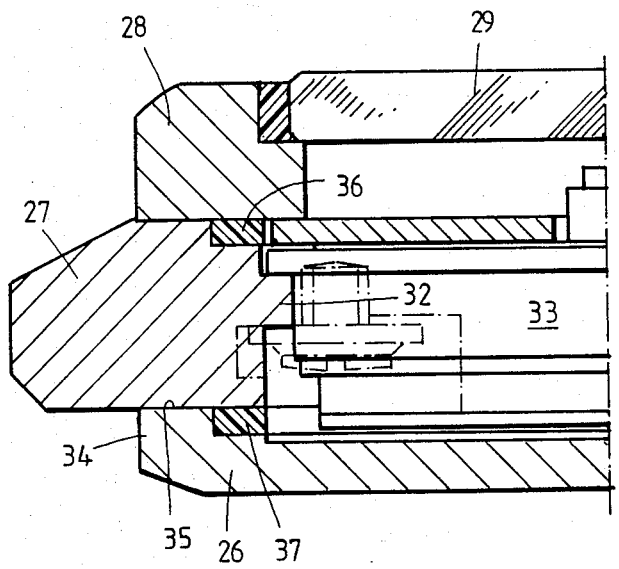
FIG. 7 is a sectional view of the same watchcase on the 6 o'clock-12 o'clock axis.

The watchcase illustrated in FIGS. 5–7 is square. As may be seen in FIG. 6, it is likewise composed of three parts joined by means of screws 25: a back 26, a caseband 27, and a bezel 28. This last component, in the shape of a frame, supports a thin, flat glass 29. It includes at its corners outer extensions 30 which run diagonally and fit down into indentations 31 in caseband 27. Extensions 30 constitute pillars in which the tapped holes for screws 25 are provided. Caseband 27 has a projecting inside fillet 32 for fixing a movement 33 by means of conventional dog screws, and its square periphery determines the size and shape of the watchcase.

FIG. 6 shows back 26 provided with low sidewalls 34, the tops of which are flat and bear against the underside of caseband 27. In each corner, back 26 has holes accommodating the heads of screws 25, as in the first embodiment. Gaskets 36 and 37 are disposed as in FIG. 3. A watchband may be affixed to the watchcase of FIGS. 5–7 by means of bars (not shown) fitted into elongated recesses which will be made in the lower edges of the sides of caseband 27 at the locations of 12 o'clock and 6 o'clock.

A thin, elegant, three-piece watchcase is thus obtained, certain zones of which are clearly visible on the outside of the case. The advantage of this design is that it makes possible wide variations of shape, surface appearance, and even coloring of the several components of the watchcase. For example, finishing of the inclined top surface of bezel 7 can be carried out under conditions which would not be possible if that surface were extended laterally toward the outside by a flat zone, whereas because the flat zone which surrounds it forms part of the caseband, such finishing is possible in the embodiment described. Thus, certain surfaces can be polished while others are streaked or matt, etc. With the design described, color effects may also be provided by selecting the metals or the electroplating treatments of the various case components accordingly. For instance, the main part constituting the caseband may be treated to take on a black hue while the bezel is of gold or is gold-plated, giving the watchcase a particularly attractive appearance. If the back is of a material having a third color, or has undergone a surface treatment giving it a third color, the attractiveness of the case may be still further increased.

With the design described above, watchcases of minimal thickness which are still compatible with the requirements for rigidity can be produced. They make it possible to use very thin mineral glasses, e.g., sapphire glasses from 0.6 to 0.8 mm thick, and to mount these glasses on very thin bezels which are securely held by the pillars they comprise.

Finally, when screws 25 are tightened, the two gaskets are compressed in the same way.

What is claimed is:

1. A watchcase of the type having an annular main part constituting a caseband and two auxiliary parts constituting a bezel and a back, wherein the improvement comprises:

a number of indentations distributed along the periphery of said caseband and a like number of pillars integral with one of said auxiliary parts, said pillars being fitted into said indentations, and the other one of said auxiliary parts being fixed against said pillars.

2. The watchcase of claim 1, wherein said pillars are formed in one piece with said bezel.

3. The watchcase of claim 2, wherein said bezel includes an annular zone along the inner periphery thereof, further comprising a groove and a glass held in said groove, disposed in said annular zone, said pillars taking the form of protruding elements extending in plan outside said annular zone.

4. The watchcase of claim 3, wherein said caseband and said back extend in plan beyond the contour of said annular zone of said bezel at least along part of the contour of said watchcase, thereby defining the outside contour of said watchcase.

5. The watchcase of claim 1, wherein said back includes protruding elements distributed in pairs along the periphery of said back and acting as horns, said protruding elements extending in height over the side of said caseband.

6. The watchcase of claim 1, wherein said pillars include tapped holes, further comprising axially disposed screws driven into said tapered holes for fixing said two auxiliary parts to one another.

7. The watchcase of claim 6, wherein said caseband includes in the face thereof nearest said bezel a groove having the shape of said bezel, said bezel being centered relative to said caseband within said groove.

8. The watchcase of claim 1, further comprising two annular gaskets borne by said caseband on the face thereof nearest said bezel and on the face thereof nearest said back, respectively, and means for fixing said bezel directly to said back, thereby compressing said gaskets axially for rendering said watchcase fluid-tight.

* * * * *